US008138683B2

(12) United States Patent
Catoul et al.

(10) Patent No.: US 8,138,683 B2
(45) Date of Patent: Mar. 20, 2012

(54) METHOD FOR CONTROLLING A SERIES CIRCUIT CURRENT OF A LIGHTING INSTALLATION AT AN AIRFIELD OR THE LIKE, AND A CONSTANT-CURRENT REGULATOR

(75) Inventors: Pierre Catoul, Bonheiden (BE); Daniel Tessens, Herent (BE); Jean-Claude Vandevoorde, Steenkokkerzeel (BE)

(73) Assignee: ADB BVBA (BE)

( * ) Notice: Subject to any disclaimer, the term of this patent is extended or adjusted under 35 U.S.C. 154(b) by 589 days.

(21) Appl. No.: 12/083,250

(22) PCT Filed: Oct. 9, 2006 (Under 37 CFR 1.47)

(86) PCT No.: PCT/EP2006/067173

§ 371 (c)(1), (2), (4) Date: Jun. 9, 2009

(87) PCT Pub. No.: WO2007/042488

PCT Pub. Date: Apr. 19, 2007

(65) Prior Publication Data

US 2010/0283400 A1 Nov. 11, 2010

(30) Foreign Application Priority Data

Oct. 10, 2005 (DE) ..... 10 2005 048 906
Jan. 4, 2006 (DE) ..... 10 2006 000 790

(51) Int. Cl.
*H05B 37/02* (2006.01)

(52) U.S. Cl. ..... 315/276; 315/220; 315/279

(58) Field of Classification Search ..... 315/220, 315/209 R, 219, 221, 223, 276, 277, 278, 315/279

See application file for complete search history.

(56) References Cited

U.S. PATENT DOCUMENTS

| | | | | |
|---|---|---|---|---|
| 5,099,177 | A | 3/1992 | Doya | |
| 5,498,936 | A * | 3/1996 | Smith | 315/247 |
| 6,573,840 | B1 | 6/2003 | Backstrom et al. | |
| 6,812,652 | B2 * | 11/2004 | Munson et al. | 315/274 |
| 2004/0075546 | A1 | 4/2004 | Hadar | |

FOREIGN PATENT DOCUMENTS

| | | | |
|---|---|---|---|
| DE | 19750560 | A1 | 5/1999 |
| GB | 1012069 | A | 12/1965 |
| GB | 2074328 | A | 10/1981 |

* cited by examiner

*Primary Examiner* — David Hung Vu
(74) *Attorney, Agent, or Firm* — Tucker Ellis & West LLP

(57) ABSTRACT

Disclosed is a method for controlling a series circuit current of a lighting installation at an airfield or the like, in which case the series circuit current which flows through transformers which are arranged on the secondary side of an output transformer and are connected in series, in order to supply lighting appliances is controlled by means of a thyristor module, which is arranged on the primary side of the output transformer and has a variable trigger angle, in which case, when a control unit is in a constant-current mode, the trigger angle is set in such a manner that a series circuit current which corresponds essentially to a rated output current flows. The invention also relates to a constant-current regulator for carrying out the method.

18 Claims, 3 Drawing Sheets

METHOD FOR CONTROLLING A SERIES CIRCUIT CURRENT OF A LIGHTING INSTALLATION AT AN AIRFIELD OR THE LIKE, AND A CONSTANT-CURRENT REGULATOR

CROSS REFERENCE TO RELATED APPLICATIONS

This application is the US National Stage of International Application No. PCT/EP2006/067173, filed Oct. 9, 2006 and claims the benefit thereof. The International Application claims the benefits of German application No. 10 2005 048 906.0 filed Oct. 10, 2005 and of German application No. 10 2006 000 790.5 filed Oct. 4, 2006, all of the applications are incorporated by reference herein in their entirety.

FIELD OF INVENTION

The invention relates to a method for controlling a series circuit current of a lighting installation at an airfield or the like, as claimed in the claims, and to a constant-current regulator for carrying out the control method as claimed in the claims.

BACKGROUND OF THE INVENTION

Lighting installations at an airport or the like emit light signals for the orientation and guidance of aircraft which are on the approach to the airport or are moving on its take-off or landing runways, or taxiways. Lighting installations comprise all the lighting aids which are intended to guarantee safe flight operations and safe taxiing of aircraft in the area of an airport, even when it is dark and/or in poor visibility conditions. In this case a distinction is drawn, inter alia, between approach lighting, glide-angle lighting, threshold lighting, side and center lighting, take-off and landing runway lighting, taxiway lighting, identification lights, hazard lights, obstruction lights and rotating lights.

In order to prevent an aircraft pilot from being irritated by light signals with a fluctuating brightness, a constant current must be supplied to the series circuit of a lighting installation. Constant-current regulators are used for this purpose, which provide a constant rated output current in varying conditions, for example fluctuations in the mains input voltage or frequency, the ambient temperature, the height above sea level of their location, relative air humidity and the applied load.

The German product specification "Konstantstromregler Mikroprozessor-gesteuert: A.06.350d" [Constant-current regulator, microprocessor-controlled], Order No. E10001-T95-A52-V2, issued in 1995 by Siemens A G, discloses a constant-current regulator for supplying series circuits in airport lighting installations with various brightness levels. The constant-current regulator has a power module with thyristors connected back-to-back in parallel, a high-voltage section with an output transformer, and a control module which controls the feed voltage for the output transformer via the thyristors. The control module for this purpose determines a thyristor trigger angle, by means of which the output current is matched to a rated value whose magnitude in turn depends on the selected brightness level.

If lamps having a filament are used as lighting appliances in the lighting installation, for example tungsten-halogen lamps, then there is a certain time interval between the instant at which the constant current is applied and the time at which the filament reaches the full light power, whose duration depends on the selected brightness level of the lamps. This reaction delay occurs, for example, on switching on and in the event of short interruptions in the power supply, where a changeover takes place from mains operation to a standby power supply. Until the full light intensity is reached, however, a pilot is not provided with a usable light signal.

On the one hand, the ICAO (International Civil Aviation Organisation) Standard, Annex 14, Volume I, Paragraph 8.1.4 requires that the light output for certain lighting appliances must be up to 50% reproduced within one second after a short current interruption. Lighting appliances which are supplied from a constant-current regulator cannot satisfy this requirement in the event of current interruptions of more than 270 ms, as a result of the physical characteristics of halogen lamps. On the other hand, the currently existing standards from the FFA (Federal Aviation Association), AC 150/5345-10E, from the IEC (International Electrotechnical Commission), 61822 and from CENELEC (Comite Europeen de Normalisation Electrotechnique), ENV 50231 for constant-current regulators demand that the rated current in the series circuit corresponding to the selected brightness must not be exceeded.

SUMMARY OF INVENTION

The invention is thus based on the object of providing a control method and a constant-current regulator of the type mentioned in the introduction in each case, which allow fast reproduction of optical light signals for air traffic control at airfields even after a short interruption in the power supply.

The object element which relates to the method is achieved according to the invention by a control method of this generic type in which the features of the characterizing part of patent claims are provided. Since the control unit can change automatically from the known constant-current mode to an overcurrent mode, in which the series circuit current is regulated at an overcurrent that is greater than the rated output current during a selectable time period, it is possible for the light signal to resume operation quickly after short power interruptions. A short, controlled overcurrent shortens the reaction time between the start of the current flow and the time at which the lighting appliances reach the full light power, thus making the operation of the lighting installation safer.

In one preferred refinement of the control method according to the invention, in the event of an interruption in an input voltage which is applied to the thyristor module, the time period of the interruption is determined, and the overcurrent duration is matched to the interruption duration. This makes it possible to assess the level of cooling of a lamp filament in the lighting appliances, which depends on the time duration of the voltage failure. During a relatively short interruption period, a filament cools less intensely, so that a specific overcurrent need be applied for only a relatively short time period for the lamp to reach the full light intensity again.

In one advantageous embodiment of the method according to the invention, the overcurrent duration is matched to the load which is applied to the secondary side of the output transformer. When the control unit is in the constant-current mode, the series circuit current can be kept constant for loads of different magnitude applied to the secondary side of the output transformer—to be precise up to 30% no-load-running series circuit transformers. In the overcurrent mode, an overcurrent which is matched to the actually applied load is likewise required, but in this case the overcurrent is chosen to be less, the less the applied load.

In one preferred embodiment of the control method according to the invention, a trigger angle which occurs at the start of the interruption is determined, and is stored and, if the interruption duration is sufficiently short, is set on the thyristor module as the trigger angle at the end of the interruption. The thyristors are thus retriggered at a predefined trigger angle rather than once again applying a current to the series circuit. This trigger angle is read from the control unit memory, and is based on the trigger angle of the output voltage which occurred immediately before the current interruption. This trigger angle is stored for approximately two seconds. If, for example, the current interruption lasts for less than one second, the constant-current regulator is started with the same no-load voltage by reading and setting this trigger angle.

In one advantageous refinement of the method according to the invention, the overcurrent is limited by impedances in the series circuit. When the control unit is in the overcurrent mode, this is therefore an impedance-dependent voltage-limiting mode, with impedances such as the series circuit transformers, coils, the output transformer or isolation transformer or else the resistance of the lamp filaments being used to prevent excessively high overcurrents which could damage the lighting appliances.

In a further preferred refinement of the control method according to the invention, the overcurrent is controlled as a function of a brightness level that is selected for the lighting appliances. For example, up to eight different brightness levels can be provided for the lighting appliances by means of output transformer rated output currents of different magnitude, for example between 2.8 A and 6.6 A. A brightness which relates to a 2.8 A series circuit current is reached at a lower filament temperature, and thus more quickly, than a brightness which relates to a 6.6 A series circuit current. In a corresponding manner, a lower overcurrent after a current interruption is sufficient for a lower brightness level than for a higher brightness level.

The rated output current to be regulated for a maximum brightness level is preferably chosen as the overcurrent. If a rated output current which does not correspond to the maximum brightness level is used for regulation purposes in the constant-current mode, then, for the sake of simplicity, the maximum rated output current can be used directly for regulation as the overcurrent.

In a further advantageous embodiment of the method according to the invention, the stored value of the trigger angle on commissioning of the lighting installation and during its operation is overwritten with the rated output current. Whenever the constant-current regulator is started up and the rated current is used, the trigger angle in the memory is overwritten, so that there is no risk of applying an excessively large overcurrent if the load changes over the course of time—for example as a result of ageing or failure of lighting appliances.

In a further advantageous refinement of the method according to the invention, a change is made from the overcurrent mode to the constant-current mode as soon as the overcurrent has fallen to a pieset threshold value above the regulated rated output current. The current regulator can automatically resume its normal constant-current mode from a threshold value of about 3% above the rated output current that is finally used for regulation.

The object element relating to the regulator is achieved according to the invention by a constant-current regulator of this generic type in which the features of the characterizing part of patent claims are provided. Since the control unit can be operated in an overcurrent mode, except when in a constant-current mode, in which overcurrent mode the series circuit current which is greater than the rated output current flows during a selectable time period, it is possible to quickly resume operation of the light signal after short current interruptions. A short controlled overcurrent shortens the reaction time between the start of the current flow and the lighting appliances reaching the full light power, thus making the operation of the lighting installation safer.

BRIEF DESCRIPTION OF THE DRAWINGS

One exemplary embodiment as well as further advantages of the invention will be explained in more detail in the following text with reference to the drawings, in which.

DETAILED DESCRIPTION OF INVENTION

Figure 1:
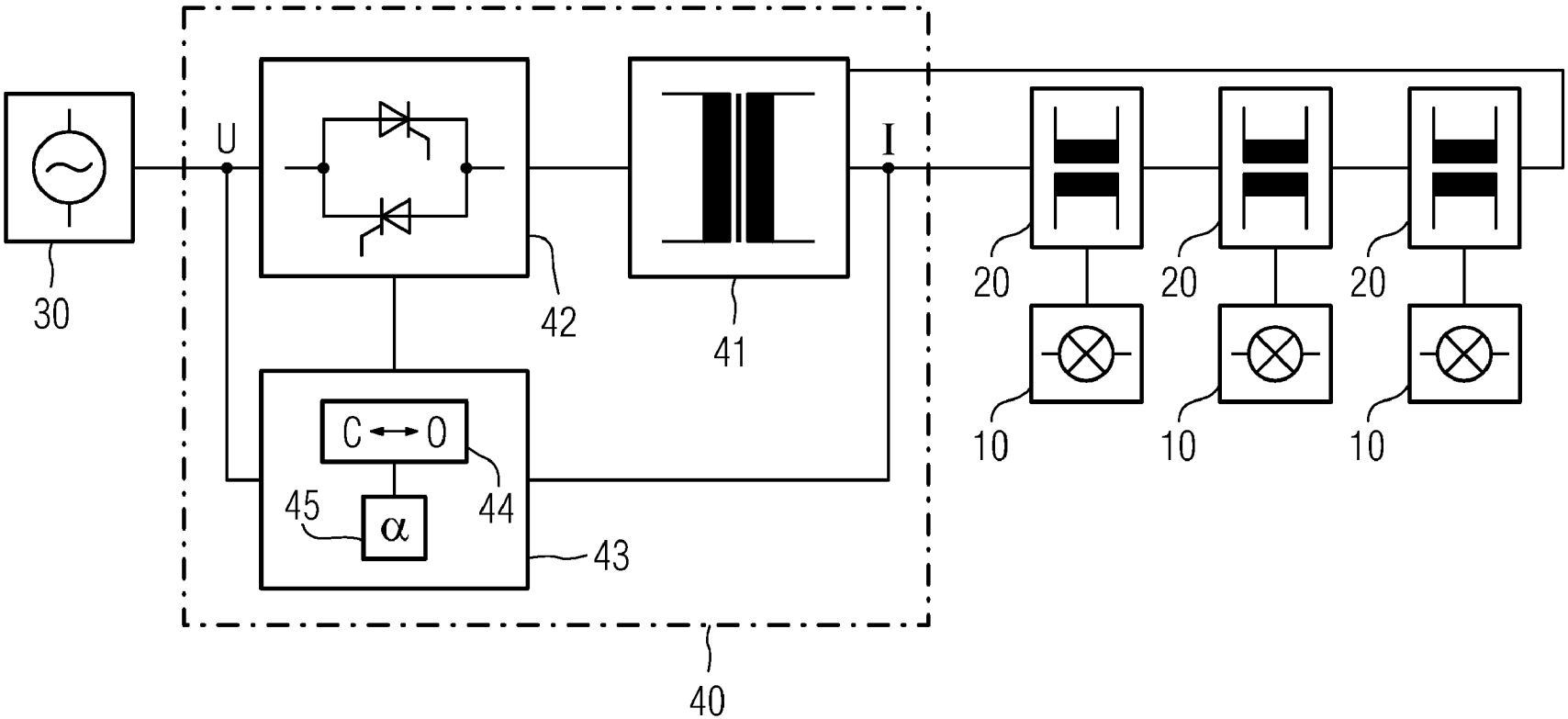
FIG. 1 shows a block diagram of a constant-current regulator according to the invention.

In FIG. 1, a lighting installation for airfields, airports, take-off and landing runways for aircraft and the like has lighting appliances 10 in the form of tungsten-halogen lamps, which represent a visual navigation aid for pilots, in particular when it is dark or in other poor visibility conditions. The lighting appliances 10 are supplied via transformers 20 which are connected in series and are supplied with a constant current I in order to ensure that a defined visual signal is emitted. A constant-current regulator 40 which is fed with an input voltage U via a mains voltage connection 30 is used for this purpose. The constant-current regulator 40 has an output transformer 41, to whose secondary side the series circuit with the series circuit transformers 20 is connected. On the primary side, the output transformer 41 is connected to a thyristor module 42 in which two thyristors which are connected back-to-back in parallel form a control element, to which the input voltage U is applied. The input voltage U may differ from its rated value because of amplitude and frequency fluctuations, and the output current I in the series circuit may differ from its rated value because of load fluctuations. Fluctuations such as these are compensated for by a control unit 43 for the constant-current regulator 40 with a microprocessor 44 by setting a trigger angle a for the thyristor module 42 in such a way that a constant rated output current $I_n$ is ensured in the series circuit.

In addition to this constant-current mode C, the control unit 43 has an overcurrent mode O, in which case, according to the invention, it is possible to switch automatically between the two operating modes. A change is made to the overcurrent mode O in order to make it possible to quickly reproduce the visual signals from the lighting appliances after short interruptions in the power supply, in order to make it possible to safely guide air traffic in the area of airfields and the like.

Figure 2:
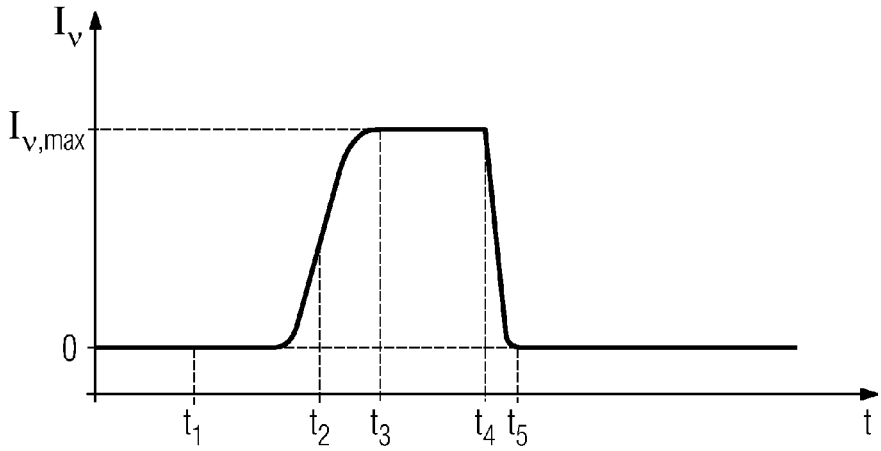
FIG. 2 shows a time curve profile of the light current emitted from a lamp filament at given current flow switch-on and switch-off times.
Figure 3:
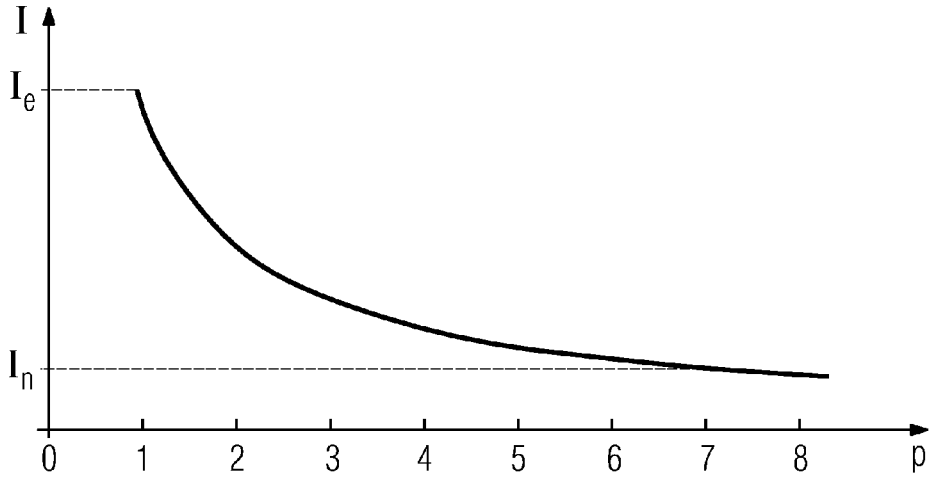
FIG. 3 shows a time curve profile of a decaying inrush current in the cold lamp filament.

With regard to the physical background, reference should be made here to FIG. 2 and FIG. 3. FIG. 2 shows the relative light intensity $I_v$ as a function of time t, depending on the current flow to a lamp filament of a lighting appliance which is in the form of a tungsten-halogen lamp. When the lamp is still cold, the lamp filament starts to emit light at a time $t_2$ approximately 1.5 s after the instant $t_1$ at which the constant current is applied. Overall, the period before the full light intensity $I_{v,max}$ is reached at the time $t_3$ may even be more than 2 s. If the selected brightness level is low, this time may even be more than 12 s. During this time, a pilot is not provided with a usable light signal. This long reaction delay is caused by the low electrical resistance of the cold lamp filament, which also limits the light that is produced. Switching off the current flow at the time $t_4$ leads to rapid cooling of the lamp filament, so that no more light is emitted even at the time $t_5$.

FIG. 3 illustrates the behavior of the current I in cold lamps. The inrush current $I_n$ to the lamp is approximately six times greater than the rated current $I_n$. After switch-on, the current I decays quickly and reaches its rated value $I_n$ after approximately eight periods p. It is, of course, possible to measure even higher inrush currents since the impedances of the power supply represent the only current limits.

Figure 4:
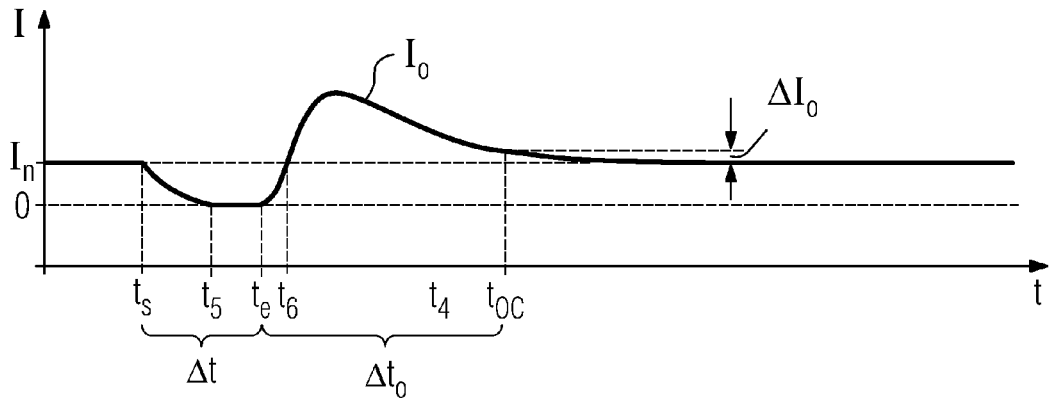
FIG. 4 shows a time curve profile for a first variant of the regulated series circuit current when a short current interruption occurs.

FIG. 4 now shows the time profile of the series circuit current I in the event of a current interruption which starts at the time $t_s$ and ends at the time $t_e$ after a time period Δt of about 500 ms. In this case, the light output falls to zero in less than 270 ms of the time $t_5$. According to the invention, the microprocessor 44 changes to the overcurrent mode O at the end $t_e$ of the interruption period Δt, thus allowing a short controlled overcurrent $I_o$ to flow in the seriescircuit. At the start $t_s$ of the interruption in the power supply to the constant-current regulator 40, the value of its output voltage, that is to say the trigger angle a of the thyristors, is stored in a memory 45 in the control unit 43 for a short time of about 2 s. When the power supply for the constant current regulator 40 is reproduced, the duration of the current interruption Δt is calculated. If this current interruption lasts for a predeterminable value of less than about 1 s, the constant-current regulator 40 is started with the same no-load voltage by setting that thyristor trigger angle a which was being used at the time $t_s$ of the current interruption. Depending on the duration Δt of the current interruption, the overcurrent $I_o$ will have to flow for a greater or lesser period of time in order to achieve a filament temperature which is adequate for light emission. Impedances in the circuit, such as coils, the output transformer or isolation transformer for the constant-current regulator 40, are used to prevent excessively large overcurrents $I_o$, which could damage the lamps. In the illustrated example, the overcurrent $I_o$ is approximately 1.5 times the rated current $I_n$, so that the light output is reproduced at the time $t_6$, within 230 ms. If the overcurrent is twice the rated current, the power which is consumed in the filament is four times the power in a pure constant-current circuit, since the power is proportional to the square of the current level. In this case, it takes only a quarter of the time which is normally required to heat the filament for light emission. When the current I falls again to a preset value $\Delta I_0$, for example to 3% above the rated output current $I_n$ which is finally used for regulation purposes, the constant-current regulator 40 automatically continues its normal constant-current mode C. As shown in FIG. 4, this takes place at the end of the overcurrent period $\Delta t_o$ at the time period $t_{OC}$.

Figure 5:
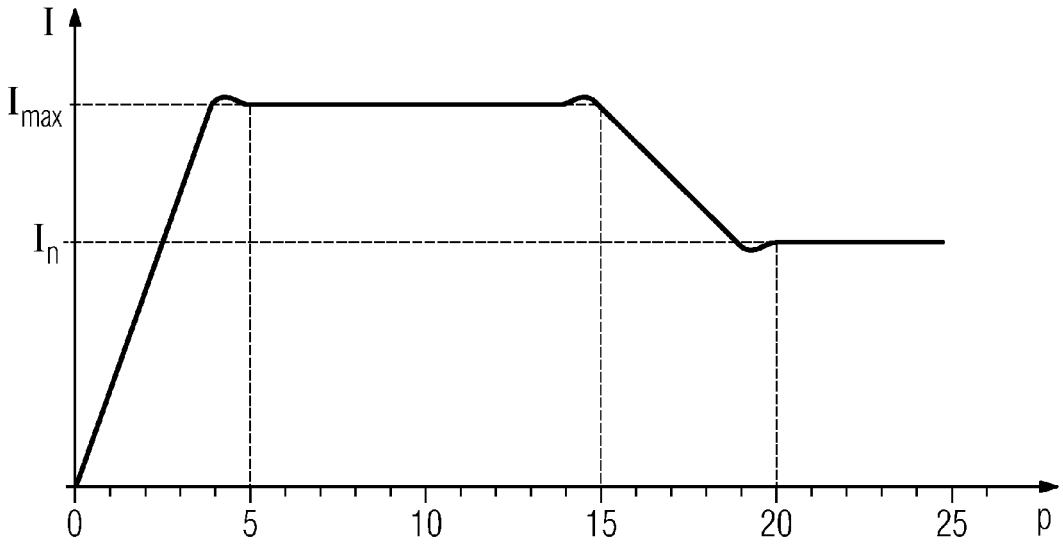
FIG. 5 shows a time curve profile for a second variant of the regulated series circuit current when a short current interruption occurs, illustrated schematically.

If a rated output current In for less than the maximum brightness level had been selected before the current interruption, then the rated current $I_{max}$ for maximum brightness should be fed in for a short time in an alternative accelerated overcurrent mode O as shown in FIG. 5, the duration of which time depends on the length of the current interruption. This operating mode O allows the required light intensity to be reached even more quickly. The rated current $I_{max}$ for the maximum brightness level is applied for a predeterminable number of periods p, for example five, and is maintained during a further predeterminable number of periods p, for example ten. The two period numbers p can be set within certain limits in such a way as to maintain the best possible matching to the applied load.

Whenever the regulator is started up and the rated current $I_n$ is being used, the trigger angle a in the memory 44 is overwritten, so that there is no risk of applying an excessively large overcurrent if the load varies over the course of time—for example as a result of ageing or failure of lamps.

According to the invention, dangerous delays in the light signals after a short interruption in the power supply to the constant-current regulator, such as those which occur when the power supply switches from mains operation to the standby mode or vice versa, are overcome. The constant-current regulator according to the invention complies with the ICAO Standard, Paragraph 8.2, Table 8.1, and allows safe landing procedures, even in poor visibility conditions. In summary, the invention is based on an approach to circumvent physical effects which prevent rapid reproduction of light signals after a short interruption in the power supply to constant-current regulators.

The invention claimed is:

1. A method for controlling a series circuit current of a lighting installation, comprising:

arranging a plurality of transformers in series on a secondary side of an output transformer; and controlling a series circuit current that flows through the plurality of transformers via a thyristor module arranged on the primary side of the output transformer and has a trigger angle, wherein when a control unit is in a constant-current mode, the trigger angle is set in such a manner that a series circuit current which corresponds essentially to the rated output current flows, and in an overcurrent mode of the control unit, the trigger angle is set in such a manner that a series circuit current which is greater than the rated output current flows during a selectable time period.

2. The method as claimed in claim 1, wherein in the event of an interruption in an input voltage applied to the thyristor module, the time period of the interruption is determined, and the overcurrent duration is matched to the interruption duration.

3. The method as claimed in claim 1, wherein the overcurrent duration is matched to the load applied to the secondary side of the output transformer.

4. The method as claimed in claim 1, wherein a trigger angle occurs at the start of the interruption is determined, and is stored and, if the interruption duration is sufficiently short, is set on the thyristor module as the trigger angle at the end of the interruption.

5. The method as claimed in claim 1, wherein the overcurrent is limited by impedances in the series circuit.

6. The method as claimed in claim 1, wherein the overcurrent is controlled as a function of a brightness level selected for the lighting appliances.

7. The method as claimed in claim 6, wherein the rated output current set for a maximum brightness level is chosen as the overcurrent.

8. The method as claimed in claim 1, wherein, upon commissioning of the lighting installation and during its operation, the stored value of the trigger angle is overwritten with the rated output current.

9. The method as claimed in claim 1, wherein a change is made from the overcurrent mode to the constant-current mode as soon as the overcurrent has fallen to a preset threshold value above the regulated rating output current.

10. A constant-current regulator that controls a series circuit current of a lighting installation, comprising:

a plurality of transformers connected to one another in series;

an output transformer connected on the secondary side to the plurality of series-connected transformers that supply lighting appliances;

a thyristor module arranged on the primary side of the output transformer having a variable trigger angle; and a control unit that sets the trigger angle where the control unit is operable in:

a constant-current mode where a series circuit current that corresponds essentially to a rated output current flows, and an overcurrent mode where a series circuit current greater than the rated output current flows during a selectable time period.

11. The constant-current regulator as claimed in claim 10, wherein in the event of an interruption in an input voltage applied to the thyristor module, the time period of the interruption is determined, and the overcurrent duration is matched to the interruption duration.

12. The constant-current regulator as claimed in claim 10, wherein the overcurrent duration is matched to the load applied to the secondary side of the output transformer.

13. The constant-current regulator as claimed in claim 10, wherein a trigger angle occurs at the start of the interruption is determined, and is stored and, if the interruption duration is sufficiently short, is set on the thyristor module as the trigger angle at the end of the interruption.

14. The constant-current regulator as claimed in claim 10, wherein the overcurrent is limited by impedances in the series circuit.

15. The constant-current regulator as claimed in claim 10, wherein the overcurrent is controlled as a function of a brightness level selected for the lighting appliances.

16. The constant-current regulator as claimed in claim 15, wherein the rated output current set for a maximum brightness level is chosen as the overcurrent.

17. The method as claimed in claim 10, wherein, upon commissioning of the lighting installation and during its operation, the stored value of the trigger angle is overwritten with the rated output current.

18. The constant-current regulator as claimed in claim 10, wherein a change is made from the overcurrent mode to the constant-current mode as soon as the overcurrent has fallen to a preset threshold value above the regulated rating output current.

* * * * *